US005664813A

United States Patent [19]

Gromotka

[11] Patent Number: 5,664,813

[45] **Date of Patent: *Sep. 9, 1997**

[54] LEVER LATCH

[75] Inventor: Gabriel Gromotka, Caledonia, N.Y.

[73] Assignee: Southco, Inc., Concordville, Pa.

[ * ] Notice: The term of this patent shall not extend beyond the expiration date of Pat. No. 5,609,373.

[21] Appl. No.: 618,470

[22] Filed: Mar. 18, 1996

Related U.S. Application Data

[60] Continuation of Ser. No. 29,477, Mar. 11, 1993, Pat. No. 5,609,373, which is a division of Ser. No. 838,313, Feb. 20, 1992, Pat. No. 5,267,762.

[51] Int. Cl.[6] ..... E05C 3/02

[52] U.S. Cl. ..... 292/229; 292/113; 292/DIG. 31; 292/210

[58] Field of Search ..... 292/229, DIG. 31, 292/241, 210

[56] References Cited

U.S. PATENT DOCUMENTS

| | | | |
|---|---|---|---|
| 2,722,445 | 11/1955 | Cudney | 292/229 |
| 2,927,812 | 3/1960 | Smith et al. | 292/DIG. 31 X |
| 3,030,137 | 4/1962 | Cheney . | |
| 3,237,978 | 3/1966 | Swanson . | |
| 3,542,410 | 11/1970 | Poe . | |
| 3,759,417 | 9/1973 | Wheeler . | |
| 3,998,481 | 12/1976 | Anthone . | |
| 4,025,094 | 5/1977 | Mitchell | 292/DIG. 31 X |
| 4,114,424 | 9/1978 | Johnson . | |
| 4,134,281 | 1/1979 | Pelcin | 70/208 |
| 4,159,137 | 6/1979 | Richter . | |
| 4,318,557 | 3/1982 | Bourne et al. . | |

(List continued on next page.)

FOREIGN PATENT DOCUMENTS

| | | |
|---|---|---|
| 0259108 | 9/1988 | European Pat. Off. . |
| 1575252 | 9/1980 | United Kingdom . |
| 2189539 | 10/1987 | United Kingdom . |
| 2192927 | 1/1988 | United Kingdom . |
| 2199363 | 7/1988 | United Kingdom . |
| 2229761 | 3/1990 | United Kingdom . |
| 2249807 | 5/1992 | United Kingdom . |
| WO8801332 | 2/1988 | WIPO . |

OTHER PUBLICATIONS

Search Report dated Dec. 18, 1992.

Search Report dated Apr. 02, 1993.

Eberhard Manufacturing Co., (Ohio, 1988), pp. I10–I13.

The Hartwell Corporation, (California, 1984).

Southco Fasteners Handbook 40, (Southco, Inc., Pennsylvania, 1990) pp. E15–E18, and F–2.

*Primary Examiner*—Rodney M. Lindsey

*Attorney, Agent, or Firm*—Paul & Paul

[57] ABSTRACT

The present invention provides a lever latch for securing a door panel of a cabinet or the like in a closed position relative to the frame. The lever latch is installed within an aperture formed in the door, and releasably retains the door against the frame when the door and the frame are latched together. The lever latch includes a housing for mounting in the door, a handle assembly which is pivotally attached to the housing, and rotatable between an opened and closed position, and a fastening means. The fastening means retains the door, when the door is closed against the frame, by engaging the frame as the handle assembly is rotated to the closed position. The housing, handle assembly and fastening means form a integral solid structure for preventing the passage of matter through the latch itself. The lever latch further includes a biasing means which is adapted to retain the handle assembly in the closed position, urge the handle assembly from the closed position to the opened position upon disengagement and provide initial accelerated movement to the handle assembly toward the opened position upon disengagement thereof. A trigger means is also included for latching the handle assembly in the closed position, and unlatching the handle assembly from the closed position for movement to the opened position. The trigger means which is integrally disposed within the central vicinity of the handle assembly provides increased mechanical advantage during the closing thereof.

30 Claims, 2 Drawing Sheets

U.S. PATENT DOCUMENTS

| | | | |
|---|---|---|---|
| 4,372,591 | 2/1983 | Cook et al. . | |
| 4,487,440 | 12/1984 | Beijer . | |
| 4,602,812 | 7/1986 | Bourne . | |
| 4,693,503 | 9/1987 | Bisbing | 292/210 |
| 4,743,052 | 5/1988 | Stammreich et al. . | |
| 4,826,221 | 5/1989 | Harmon . | |
| 4,828,299 | 5/1989 | Poe . | |
| 4,877,274 | 10/1989 | Poe . | |
| 4,911,485 | 3/1990 | Wasilowski | 292/DIG. 31 X |
| 4,991,885 | 2/1991 | Poe . | |
| 5,129,694 | 7/1992 | Tanimoto et al. | 292/DIG. 31 X |
| 5,267,762 | 12/1993 | Gromotka | 292/DIG. 31 X |

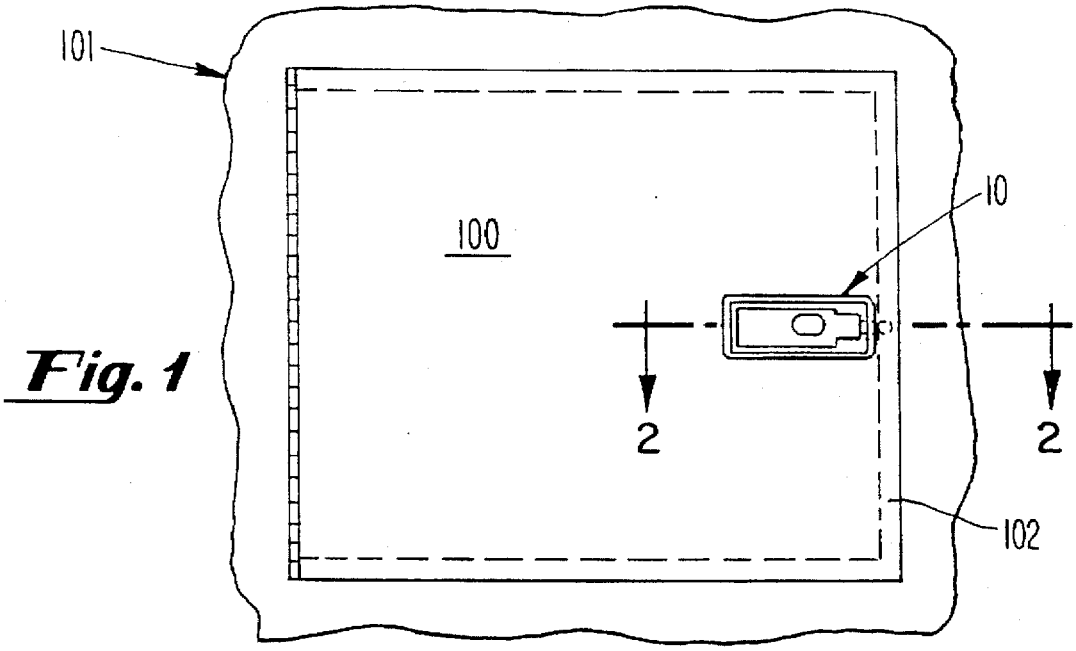
Fig. 1
Fig. 2
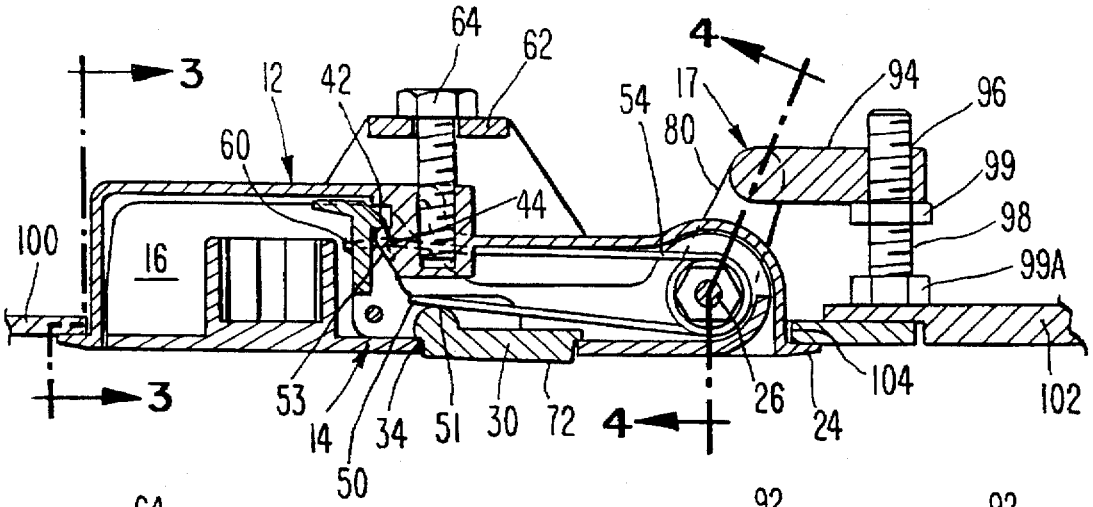
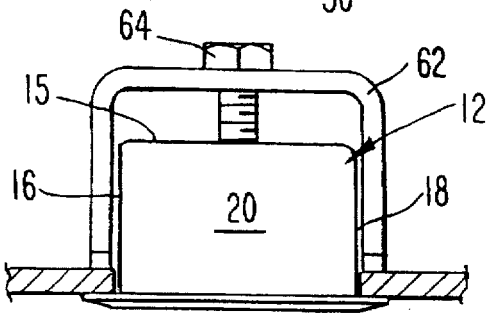
Fig. 3
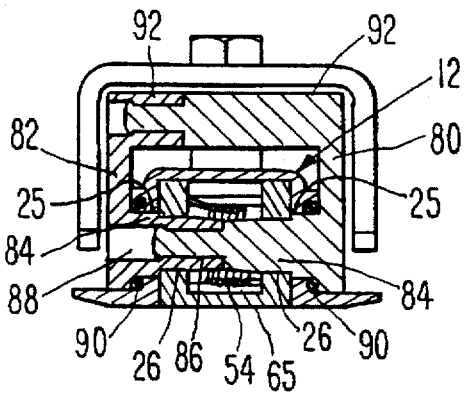
Fig. 4

LEVER LATCH

CROSS-REFERENCES TO RELATED APPLICATIONS

This is a continuation of application Ser. No. 08/029,477 filed Mar. 11, 1993, now U.S. Pat. No. 5,609,373, which is a division of application Ser. No. 07/838,313, filed Feb. 20, 1992, now identified by U.S. Pat. No. 5,267,762.

BACKGROUND OF THE INVENTION

1. Field of the Invention

The present invention relates generally to latching devices and more particularly to lever latches for fastening hinged doors, panels and the like.

2. Brief Description of the Prior Art

Various types of latching devices for fastening doors, panels and the like are known.

Some types incorporate a spring to bias a latch bolt into a latched position about a keeper. Rotary handles are provided so that the latch bolt may be rotated away from the keeper in opposition of the spring, and into an unlatched position. However, the handle of such a latch which extends beyond the body may cause inadvertent latching and unlatching in response to impact forces.

Another type are "trigger release lever" latches which incorporate a handle in combination with a trigger in order to compress an arm and a stop against an inner surface of a cabinet frame. The handle and trigger when latched are positioned substantially flush with the outer surface of the door which prevents inadvertent unlatching from the latched position. A housing is included to which the handle is rotatably connected and the trigger of such latches is pivotally connected either to the housing or to the handle. In U.S. Pat. No. 4,693,503, an example of a trigger release lever latch is shown comprising a flanged housing, a handle and a trigger which are inserted within an opening in a cabinet door or the like.

One problem associated with such prior art trigger release lever latches is that a plurality of spring devices are required in order to provide proper function of the latch. For example, in latches where the trigger is pivotally connected to the housing, two springs are required in order to provide proper function. Furthermore, in such latches that provide the trigger as a pivotal part of the handle, two springs, or in some cases three springs, are utilized for proper latch operation. In particular, one spring is used which forces the trigger into the closed position, another moves the handle into the opened position upon release of the trigger, and a third gives the handle an initial rise immediately after trigger release which prevents the trigger from snapping back into the latched position.

Another problem with such prior art trigger release lever latches is that dirt, water and other matter is able to pass through the latch and into the interior compartment of the cabinet, thus causing damage to the equipment contained therein. A latex boot is oftentimes utilized which covers the back of the latch, however, this only provides partial sealing for the latch.

The present invention has been developed in view of the foregoing to overcome the deficiencies of the prior art.

SUMMARY OF THE INVENTION

The present invention provides a lever latch for mounting within a door panel of a cabinet or the like for releasably retaining the door against the corresponding frame. The lever latch includes a housing, a handle assembly and a fastening means. The handle assembly, which is pivotally attached to the housing, is rotatable between an opened and closed position. The fastening means retains the door in the closed position against the frame when the handle assembly is rotated to the closed position.

Advantageously, the present invention provides a lever latch which is capable of restricting the passage of matter through the latch itself.

It is a further advantage of the present invention to provide a biasing means in a lever latch which is capable of retaining the handle assembly in the closed position, urging the handle assembly from the closed position to the opened position upon unlatching, and providing an initial accelerated movement to the handle assembly toward the opened position upon unlatching of the device.

It is still a further advantage of the present invention to provide a trigger means in a lever latch which is integrally disposed within the central vicinity of the handle assembly for providing increased mechanical advantage during the closing thereof.

BRIEF DESCRIPTION OF THE DRAWINGS

FIG. 1 is a perspective view of a lever latch of the present invention shown mounted in a door of a cabinet, partly broken away, for securing the door to the cabinet frame, the door being shown in a closed position.

FIG. 2 is a sectional view of the lever latch taken along the line 2—2 of FIG. 1.

FIG. 3 is a sectional view of the lever latch taken along the line 3—3 of FIG. 2.

FIG. 4 is a sectional view of the lever latch taken along the line 4—4 of FIG. 2.

DETAILED DESCRIPTION OF THE PREFERRED EMBODIMENTS

Figure 6:
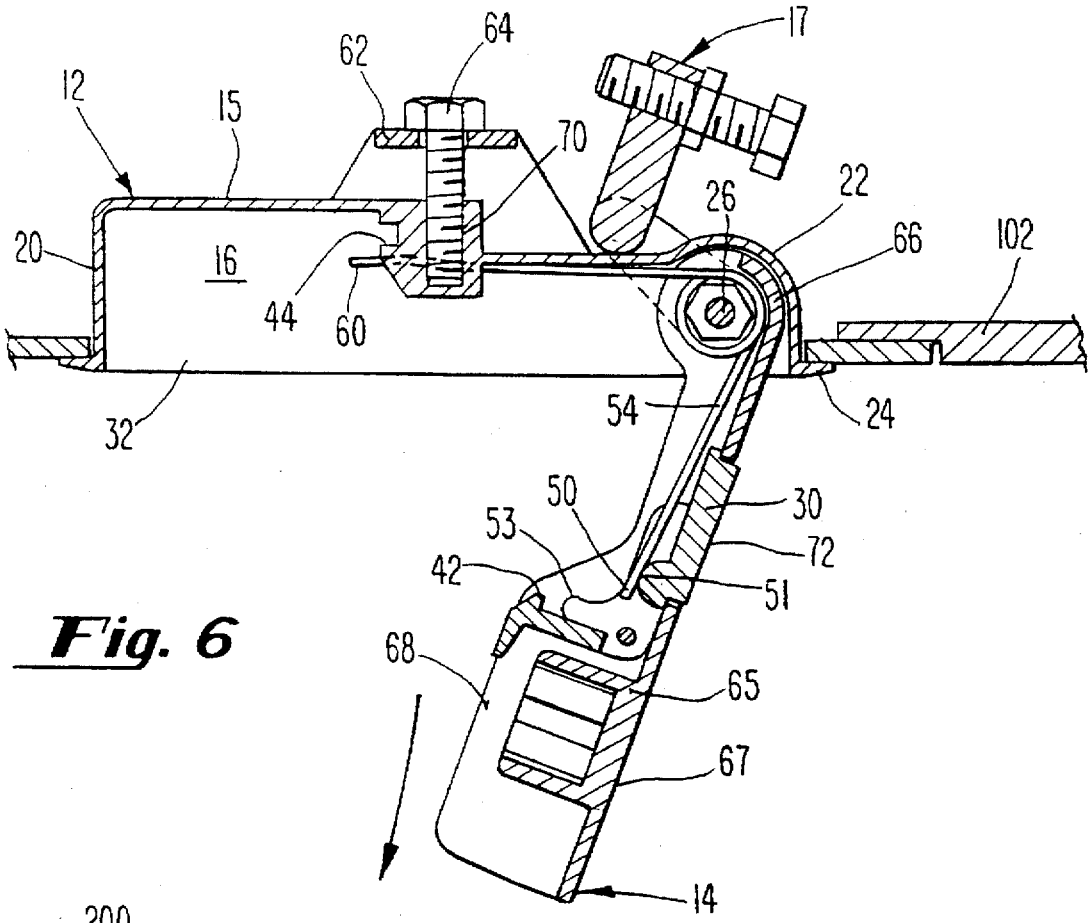
FIG. 6 is a sectional view of the lever latch of FIG. 2 shown in an opened position.

Referring now to the drawings in detail, wherein like reference numerals indicate like elements throughout the several views, there is shown in FIG. 1 a perspective view, partly broken away, of a cabinet 101 having a lever latch 10 of the present invention mounted in a door 100 thereof. The cabinet 101 may be fabricated from any suitable type of material for enclosing various equipment installed therein (not shown). Accordingly, the door 100 as illustrated in phantom in FIG. 1 is hinged to the cabinet 101 for engaging a cabinet frame 102 in a closed position. A gasket (not shown) may be affixed to the inside of the door 100 proximate the edge thereof for providing additional sealing of the door 100 when closed against the frame 102.

As shown in FIG. 2, the lever latch 10 according to the present invention includes a housing 12 for mounting in an aperture 104 formed in the door 100, a handle assembly 14 pivotally attached to the housing 12 and rotatable between an opened and closed position, and a fastening means 16 for engaging the cabinet frame 102 in the closed position.

As best seen in FIGS. 3 and 6, the housing 12 is a generally rectangular, cup-like member that is preferably of a zink die cast. However, the housing 12 according to the present invention may be produced by any appropriate method from any suitable material. Accordingly, housing 12 comprises a bottom plate 15, and a pair of generally parallel side walls 16, 18 and first and second end walls 20 and 22 extending perpendicularly upward therefrom. As best illustrated in FIG. 6, a well 32 is formed between the respective side walls 16, 18 and end walls 20, 22 for housing the handle assembly 14 when in the closed position of FIG. 2. A flange 24 is also provided extending outward from the free ends of sidewalls 16, 18 and end walls 20, 22 for abutting an outer surface of door 100 when housing 12 is mounted proximate the aperture 104 thereof. A sealing means of the gasket type (not shown) may be affixed to the underside of flange 24 for sealing the flange 24 against the outer surface of the door 100 when the housing 12 is mounted therein. Preferably, the flange 24 of the present invention is sized to prevent the passage of matter around the latch 10, through the aperture 104, and into the interior compartment of cabinet 101. Accordingly, oftentimes, it is necessary to incorporate a larger sized flange, preferably about five millimeters in length, in order to account for imperfections in the preparation of door 100 when the housing 12 is mounted therein.

Figure 5:
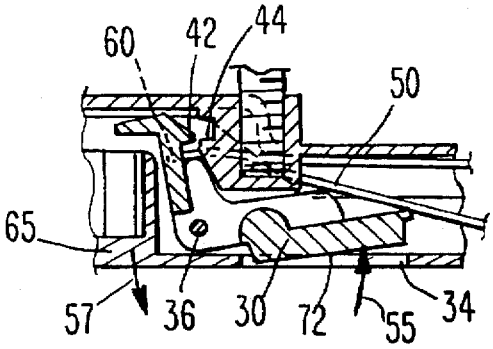
FIG. 5 is a fragmentary sectional view of the trigger of the lever latch shown in a rotated position.

As shown in FIG. 3, the housing 12 is secured within the aperture 104 by the mounting bracket 62. The bracket 62 is received over the outer surface of housing 12, engaging the inner surface of door 100 shown in FIG. 3. The bracket 62 is held in this position, engaging the door 100, by a threaded bolt 64. The bolt 64 is inserted through an opening formed in bracket 62, engaging the threads 70 provided in bottom plate 15 as shown in FIG. 5.

As previously described, the present invention is adapted to prevent the passage of matter through the latch 10, into the interior compartment of the cabinet 101. Accordingly, as illustrated in FIGS. 2 and 3, the sidewalls 16, 18 are each provided with a corresponding opening 25 (not shown in FIGS. 2 and 3) formed therethrough adjacent end wall 22, for receiving the handle assembly 14 and fastening means 17 in the manner described below. At assembly, housing 12, handle assembly 14 and fastening means 17 form an integral solid structure for preventing the passage of matter through the sealed lever latch 10.

As shown in FIG. 6, the handle assembly 14 includes a pivot 65 having a first end 66, an upper surface 67 and opposing side walls 68 (only one of which is visible) extending downward from upper surface 67. Oppositely situated apertures 26 are formed adjacent the first end 66 of pivot 65, within the respective side walls 68 thereof, for receiving the fastening means 17 in the manner described below.

As best seen in FIGS. 2 and 4, the fastening means 17 includes first and second lever members 80 and 82, each having respective first shafts 84 extending from a first end thereof. The first shafts 84 are configured to be received within the openings 25 formed within the sidewalls 16, 18 of the housing 12, and apertures 26 of the pivot 65, respectively. Preferably, the first shafts 84 are hexagonal in cross-section over a section thereof in order to be press fit within the correspondingly configured hexagonal openings 25, and apertures 26, respectively. It should be understood, however, that any appropriately configured first shafts 84, and openings 25 and apertures 26 may be provided for such purpose. As shown in FIG. 4, the first shafts 84 are also formed in such a manner to matingly interconnect along the distal ends thereof, thereby forming a one piece integral shaft member upon assembly. Preferably, the first shaft 84 of first lever member 80 includes an integral rivet member 86 protruding outward therefrom. Accordingly, the rivet member 86 is adapted to be received and peened over within a correspondingly configured receptacle 88 formed through the first shaft 84 of the second lever member 82 for completing the assembly. It is to be understood, however, that any appropriate method may be used for this purpose. A sealing means 90 of the O-ring type may also be included which is received over the respective first shafts 84 for providing additional sealing for the housing 12 against the first shafts 84, respectively. Preferably, the sealing means 90 is of an electrically conductive material for preventing the passage of electromagnetic radiation, however, the sealing means 90 according to the present invention may be produced from any suitable material.

As shown in FIGS. 2 and 4, the first and second lever members 80 and 82 are also provided with respective second shafts 92 extending from a second end thereof. The second shafts 92 are adapted to interconnect in the manner described above, also forming a one piece integral shaft member upon assembly.

As best illustrated in FIGS. 2 and 4, the second shaft 92 of the first lever member 80 is provided with a bracket 94 extending therefrom which includes a threaded opening 96 at its distal end. An adjustable bolt 98 is mounted in the threaded opening 96 and is locked in a fixed position by the action of nut 99. The head 99A of adjustable bolt 99 is positioned to contact the back surface of the frame 102 when handle assembly 14 is moved to its closed and latched position illustrated in FIG. 2.

As shown in FIGS. 2 and 5, the handle assembly 14 also includes a trigger 30 for latching and unlatching the handle assembly 14 from the closed position. As best seen in FIG. 5, the trigger 30 is rotatably mounted onto pivot 65 by a connecting member 36, for example of the spring pin type, the ends of which extending through the aligned apertures formed through the opposing side walls 68 of pivot 65, and trigger 30, respectively. Preferably, as illustrated in FIGS. 2 and 6, the connecting member 36 or second biasing means rotates an outer surface 72 of trigger 30 upward, into the opening 34 formed within the center of pivot 65. Accordingly, the trigger 30 and pivot 65 are contiguous and flush with the flange 24 of housing 12 in the closed and latched position of FIG. 2.

As shown in FIGS. 2, 5, and 6, the trigger 30 also includes a catch 42 formed at the bottom thereof. The catch 42 is adapted to engage in a latched position a keeper 44 formed in the housing 12, when the door 100 is closed against the frame 102 and the handle assembly 14 is rotated to the closed position shown in FIG. 2. As indicated earlier, it is believed that the position of trigger 30 integrally disposed within the vicinity of the center of the handle assembly 14 provides increased mechanical advantage during the closing operation thereof.

As shown in FIGS. 2, 4, and 6, a biasing means 54 of the torsion spring type is included mounted onto the first shafts 84 for retaining the catch 42 in engagement with keeper 44 by the ends 50, 60 thereof. Preferably, as best seen in FIGS. 2 and 5, the end 60 of the biasing means 54 is comprised of a formed section generally bent or otherwise shaped in the direction of the trigger 30 for a purpose described below.

The ends 50, 60 retain the trigger 30 in the latched position of FIG. 2 by engaging and urging upward trigger 30, preferably along a lower side 51 opposite outer surface 72, and a flange 53 formed adjacent the catch 42, respectively.

As shown in FIG. 5, application of force by an operator downward upon outer surface 72 of trigger 30 in the direction of arrow 55 rotates the catch 42 away from keeper 44, and the ends 50, 60 of biasing means 54 urge the trigger 30, and accordingly handle assembly 14, upward in the direction of arrow 57 from well 32. The energy stored in the formed end 60 of the biasing means 54 provides additional thrust or momentum to the trigger 30, and accordingly to the handle assembly 14, which ensures that the catch 42 will not re-engage the keeper 44 when the trigger 30 is released by the operator and rotated back to its original position. Whereafter, the fastening means 17 is moved out of contact with frame 102, as the handle assembly 14 is rotated to the opened and unlatched position of FIG. 5 by the force of the biasing means 54.

Accordingly, the biasing means 54 of the present invention provides three separate operations; it forces the trigger 30 into the latched position, moves the handle assembly 14 into the opened position following release of the trigger 30, and also gives the handle assembly 14 an initial rise of momentum after trigger release by the operator.

Figure 7:
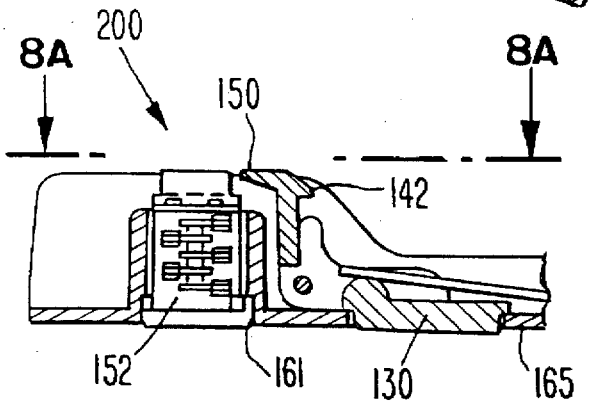
FIG. 7 is a fragmentary sectional view of an alternative embodiment of the lever latch of the present invention.
Figure 8A:
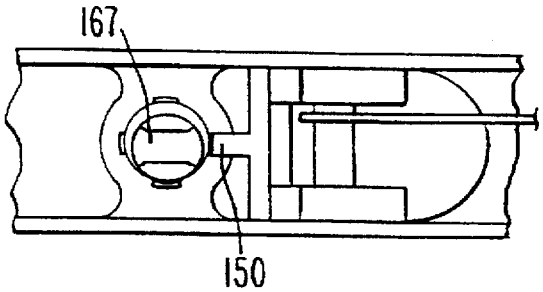
FIG. 8A is a plan view of the lever latch taken along the line 8A—8A of FIG. 7 shown in a closed and unlocked position.
Figure 8B:
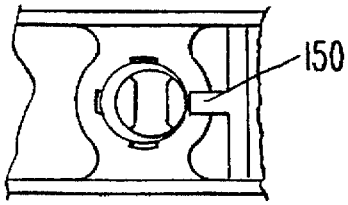
FIG. 8B is a fragmentary plan view of the lever latch of FIG. 7A shown in a closed and locked position.

In FIG. 7 is shown an alternate embodiment of the lever latch of the present invention. A conventional key lock 152 is shown mounted in an aperture 161 formed within the pivot 165 for locking the lever latch 200 in the closed position thereof. As illustrated, the trigger 130 includes a tongue 150 extending therefrom opposite the catch 142. As best seen in FIGS. 8A and 8B, the tongue 150 is configured to extend within a locking slot 167 formed in the lower end of lock 152 when in the unlocked position, and abut against the lower end of the lock 152 when the lever latch 200 is closed and locked.

It will be recognized by those skilled in the art that changes may be made to the above-described embodiments of the invention without departing from the broad inventive concepts thereof. For example, in some circumstances the end 50 of the biasing means 54 can also be utilized as a formed section for providing additional thrust or momentum to the handle assembly 14 upon unlatching. In other circumstances, the end 50 can be utilized exclusively as the only formed section for providing such function. It is understood, therefore, that this invention is not limited to the particular embodiments disclosed, but it is intended to cover all modifications which are within the scope and spirit of the invention as defined by the appended claims.

I claim:

1. A lever latch for mounting in an aperture formed in a door panel for releasably retaining the door against a corresponding frame, the latch comprising:

a housing defining an inner surface and an outer surface separated by a housing wall;

pivot means mounted on and rotatable relative to the housing;

a handle attached proximate one end thereof to said pivot means and rotatable between an open and a closed position, wherein the handle at least at its attachment with said pivot means is separated from said outer surface of the housing by said housing wall;

fastening means attached to said pivot means, wherein the fastening means at least at its attachment with said pivot means is separated from said inner surface of the housing by said housing wall, whereby the fastening means is separated from said handle by said housing wall and said fastening means engages the frame for retaining the door when the handle is rotated to its closed position.

2. A lever latch of claim 1, wherein the fastening means includes at least first and second portions attached to said pivot means proximate opposite ends of the pivot means.

3. A lever latch of claim 2, wherein the housing is positioned between said first and second portions of said fastening means.

4. A lever latch of claim 3, wherein the housing includes a pair of opposing apertures extending through said housing wall into which the pivot means is mounted.

5. A lever latch of claim 4, further comprising an O-ring between the pivot means and the housing adjacent said housing aperture.

6. A lever latch of claim 4, wherein the pivot means comprises at least two shaft portions connected to each other, with said first portion of the fastening means connected to the one shaft portion and said second portion of the fastening means connected to the second shaft portion.

7. A lever latch of claim 6, wherein the first and second portions of said fastening means comprise first and second generally elongated lever members, respectively, with the first and second lever members having the two shaft portions of the pivot means extending proximate a first end thereof.

8. A lever latch of claim 7, wherein said fastening means includes latching means connected with the first and second lever members proximate a second end thereof for fastening with the frame.

9. A lever latch of claim 1, further comprising:

a first catch member mounted on the handle for engaging with a second catch member to retain the handle in the closed position;

a biasing member for biasing the first catch member to an engaged position with the second catch member and for biasing the handle to move toward the open position from the closed position upon disengagement of the first catch member.

10. A lever latch of claim 9, wherein the housing includes a cavity defining said inner surface thereof and said handle at least at its attachment with said pivot means is received within said cavity.

11. A lever latch of claim 9, further comprising a trigger pivotally mounted on the handle and including the first catch member, wherein said second catch member comprises a keeper in the housing.

12. A lever latch of claim 11, wherein the biasing means comprises a torsion spring.

13. A lever latch of claim 12, wherein said torsion spring includes at least one wound portion through which the pivot means passes and two end portions extending from said wound portion, with each of said end portions being in engagement with said trigger.

14. A lever latch of claim 13, wherein said trigger includes a button upon which an operator presses for pivoting said trigger so that said first catch member is moved in a direction generally away from said pivot means and disengages the keeper.

15. A lever latch of claim 1, wherein said handle includes an aperture extending therethrough into which said pivot means is received, wherein said handle and pivot means includes attachment means therebetween for rotationally fixing said handle relative to said pivot means.

16. A lever latch of claim 15, wherein said pivot means has a portion having a non-circular cross-section and said aperture extending through said handle is non-circular and receives said non-circular portion of said pivot means comprising said attachment means.

17. A lever latch for mounting in an aperture formed in a door panel for releasedly retaining the door against a corresponding frame, the latch comprising:

a housing;

a handle having pivot means for attachment to the housing, the handle being rotatable between an open and a closed position;

a catch having a first catch member mounted on the handle for engaging with a second catch member in the housing to retain the handle in the closed position;

fastening means connected with the handle and adapted for engaging the frame for retaining the door when the handle is rotated to its closed position; and a biasing member for biasing the first catch member to an engaged position with the second member when the handle is in its closed position and for biasing the handle to move toward the open position from the closed position upon disengagement of the first catch member.

18. A lever latch of claim 17, wherein said biasing member comprises a torsion spring.

19. A lever latch of claim 18 further comprising a trigger pivotally mounted on the handle and including the first catch member.

20. A lever latch of claim 19, wherein said handle includes an aperture extending therethrough positioned closer to a center than to an end thereof into which said trigger is mounted.

21. A lever latch of claim 19, wherein said second catch member comprises a keeper in the housing.

22. A lever latch of claim 19, wherein said torsion spring includes at least one wound portion through which the pivot means passes and first and second end portions extending from said wound portion, with each of said end portions being in engagement with said trigger.

23. A lever latch of claim 22, wherein said trigger includes a button upon which an operator presses for pivoting said trigger so that said first catch member is moved in a direction generally away from said pivot means and disengages said second catch member.

24. A lever latch of claim 23, wherein said first end portion of said biasing member is in engagement with said trigger proximate said button and said second end portion of said biasing member is in engagement with said trigger proximate said first catch member.

25. A lever latch of claim 24, wherein said second end portion of said biasing member is formed having a bend proximate its terminating end for providing an initial rise of a momentum to the handle upon disengagement of said trigger.

26. A lever latch of claim 17, wherein said fastening means is connected with said pivot means.

27. A lever latch of claim 26, wherein said fastening means includes at least first and second portions attached to said pivot means proximate opposite ends of said pivot means.

28. A lever latch of claim 27, wherein said housing is positioned between said first and second portions of the fastening means and said housing includes a pair of opposing apertures extending through said housing into which the pivot means is mounted, wherein said pivot means is rotatable within said housing apertures.

29. A lever latch of claim 28, wherein said housing includes a cavity therein and said handle comprises a generally elongate member substantially received within said housing cavity in the closed position.

30. A lever latch of claim 29, wherein said handle includes an aperture extending therethrough into which said pivot means is received, wherein said handle and said pivot means includes attachment means therebetween for rotationally fixing said handle relative to said pivot means.

* * * * *